United States Patent [19]

Cazes

[11] Patent Number: 4,941,755

[45] Date of Patent: Jul. 17, 1990

[54] DEVICE FOR MANUFACTURING A CONTAINER OF FLEXIBLE SYNTHETIC MATERIAL

[75] Inventor: Michel Cazes, Vittel, France

[73] Assignee: Societe Generale Des Eaux Minerales De Vittel, Vittel, France

[21] Appl. No.: 158,307

[22] Filed: Feb. 19, 1988

[51] Int. Cl.[5] ..... B65D 30/16

[52] U.S. Cl. ..... 383/119; 383/96; 383/104; 220/461

[58] Field of Search ..... 383/104, 119, 96, 121.1, 383/903; 220/461, 462

[56] References Cited

U.S. PATENT DOCUMENTS

| | | | |
|---|---|---|---|
| 2,494,177 | 1/1950 | Hultin | 383/119 X |
| 3,249,286 | 5/1966 | Palmer | 383/104 X |
| 3,399,818 | 9/1968 | Stegner | 383/104 |
| 4,469,227 | 9/1984 | Faust | 383/119 X |
| 4,622,693 | 11/1986 | Mykleby | 383/119 |

FOREIGN PATENT DOCUMENTS

| | | | |
|---|---|---|---|
| 627711 | 8/1949 | United Kingdom | 383/119 |
| 651638 | 4/1951 | United Kingdom | 383/119 |

*Primary Examiner*—Stephen P. Garbe
*Assistant Examiner*—Jes F. Pascua
*Attorney, Agent, or Firm*—Weiser & Stapler

[57] ABSTRACT

Device for manufacturing a sachet of flexible synthetic material intended for packaging liquids, the said sachet initially being in the form of a cushion-like bag already full of liquid, this device enabling a means for gripping, stiffening and mounting information to be attached to the said cushion-like bag and enabling the sachet to be given its final shape for marketing and use.

It comprises means for enclosing the cushion-like bag in a sleeve of synthetic material which can be stretched and is cold-worked around clamping jaws (19, 20) which are capable of a translation of motion and a motion away from one another, between which the cushion-like bag is located.

13 Claims, 4 Drawing Sheets

2
4
5
6
19
20
21
22
23
24
30
31
32
33
34
35
36
53
54
55
56
57
58
59
F

DEVICE FOR MANUFACTURING A CONTAINER OF FLEXIBLE SYNTHETIC MATERIAL

The present invention relates to a device for manufacturing a sachet of flexible synthetic material intended for packaging liquids, the said sachet initially being in the form of a cushion-like bag already full of liquid, this device enabling a means for gripping, stiffening and mounting information to be attached to the said cushion-like bag and enabling the sachet to be given its final shape for marketing and use. The invention also relates to a process for the manufacture of such sachets, and to the sachets thus obtained.

A device of this type has already been proposed by the Applicant, for example in granted European patent 167,469. In the device described there, a cushion-like bag provided with a handle or stiffening element is fed into a retaining means, where it is given its final shape. Although it is completely satisfactory, this device nevertheless has some disadvantages insofar as the handle is applied to the cushion-like bag before it is sealed, which necessitates very rigorous monitoring of the sterile conditions.

Moreover, difficulties are encountered in ascertaining precise and regular positioning of the stiffening element. A device for positioning such a stiffening element has been proposed, for example, in the granted European Patent 146,482 of the Applicant.

It has become apparent that all these disadvantages were chiefly connected to the fact that the stiffening element is attached by sticking or welding to the tubular sheet leading to the final formation of the cushion-like bags filled with liquid.

The object of the invention is consequently to propose a device enabling these disadvantages of the prior art to be remedied, that is to say enabling a stiffening, gripping and information-mounting element to be attached to a cushion-like bag already full of liquid without problems of sterility and in a precise and regular manner.

In accordance with the invention, this result has been obtained with a device for manufacturing a sachet of flexible synthetic material intended for packaging liquids, the said sachet initially being in the form of a cushion-like bag already full of liquid, this device enabling a means for gripping, stiffening and mounting information to be attached to the said cushionlike bag and enabling the sachet to be given its final shape for marketing and use, characterized in that it comprises means for enclosing the cushion-like bag in a sleeve of synthetic material which can be stretched and is cold-worked around clamping jaws which are capable of a translational motion and a motion away from one another, between which the cushion-like bag is located.

Advantageously, the cushion-like bag will be provided with an opening and closing stopper attached to it in sterile conditions, the said stopper serving as a guiding means to ensure that the cushion-like bag is positioned precisely in the device of the invention, between the said clamping jaws.

According to a particular feature of an embodiment of the invention, the device will enable two stiffening elements to be applied, which will each be held on one side face of the cushion-like bag solely by the sleeve when the clamping jaws have been removed, the device furthermore comprising means for giving shape to the bottom of the sachet by sticking the free ends of each of the stiffening elements to one another.

As a variant, it will be possible for the device to apply a single stiffening element to the bottom of the cushion-like bag, the two wings then being folded back on the side faces of the cushion-like bag by vert-ical pistons before the stretchable sleeve is positioned According to another feature of the invention, a process is proposed for the manufacture of a sachet in flexible synthetic material provided with means for gripping, stiffening and mounting information, characterized in that the said means are attached to at least one side face of the said sachet and held on the latter only by the action of the sleeve of cold-stretchable synthetic material.

Finally, the invention also relates to sachets of the type above, that is to say in which a means for stiffening, gripping and mounting information is attached to at least one side face of the said sachet and is held there solely by the action of a sleeve of cold-stretchable synthetic material.

The invention will be better understood with the aid of the following description of one embodiment, which is given by way of non-limiting example, with the reference to the attached drawings, in which:

FIG. 3 is the diagrammatic side view of the device of the invention;

Figure 1:
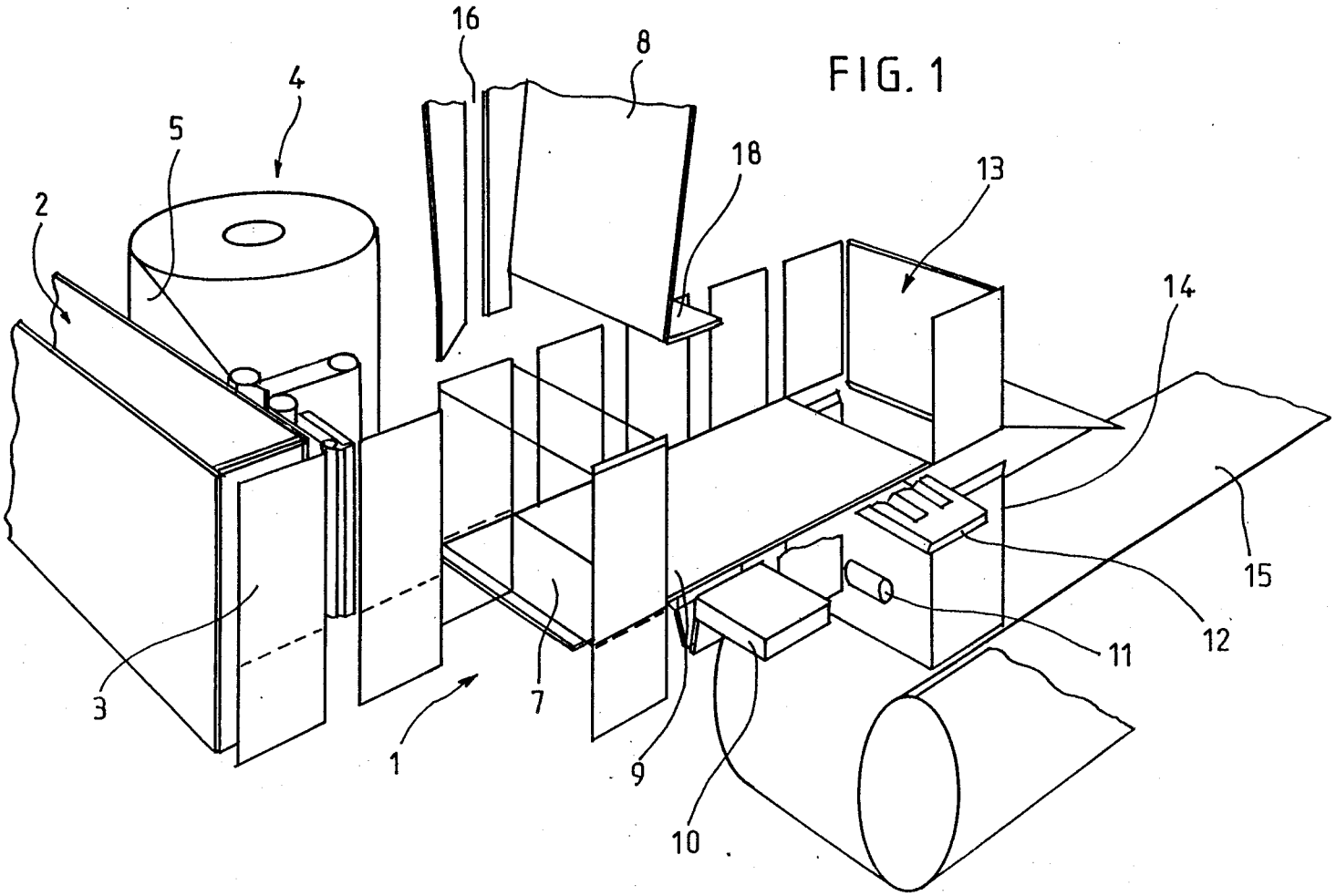
FIG. 1 is a diagrammatic perspective view of the principal elements constituting the device of the invention.

Reference will first be made to FIG. 1.

Shown there are the principal elements constituting the device of the invention, which is given the general reference (1), namely:

- a magazine (2) for supplying a reinforcing piece (3);
- a spool (4) of cold-stretchable film (5);
- a clamp of the station (6) for welding and cutting the film (5) to give it the shape of a sleeve (7);
- a chute (8) for feeding the cushion-like bags;
- a flat rail (9) on which the bottoms of the sachets are conveyed;
- a station (10) for welding the lower corners of the sachet;
- a station (11) for glueing the wing of one of the reinforcing pieces;
- a station (12) for sticking the wings of the reinforcing pieces together;

a station (13) for discharging the finished sachets, discharging them, for example, towards a bagging device (14) and a conveyor belt (15).

FIG. 1 shows some elements which are peripheral to the device of the invention and which do not appear in the other figures. They will be described in brief.

The device (1) is supplied by means of flexible sachets which are already full of liquid to be packaged and are provided with a stoppering/restoppering cap such as described, for example, in French patent application 86/09,615 of the applicant. These are a type of "cushion-like" bag of liquid.

The latter are fed onto the chute (8) and guided, thus oriented, by their stopper, which is subject to displacement in the guide slot (16) which thus feeds the said cushion-like bag in a precise and predetermined position between the clamping jaws of the device (1), which will be explained later.

Figures 3A, 3B, 3C, 3D:
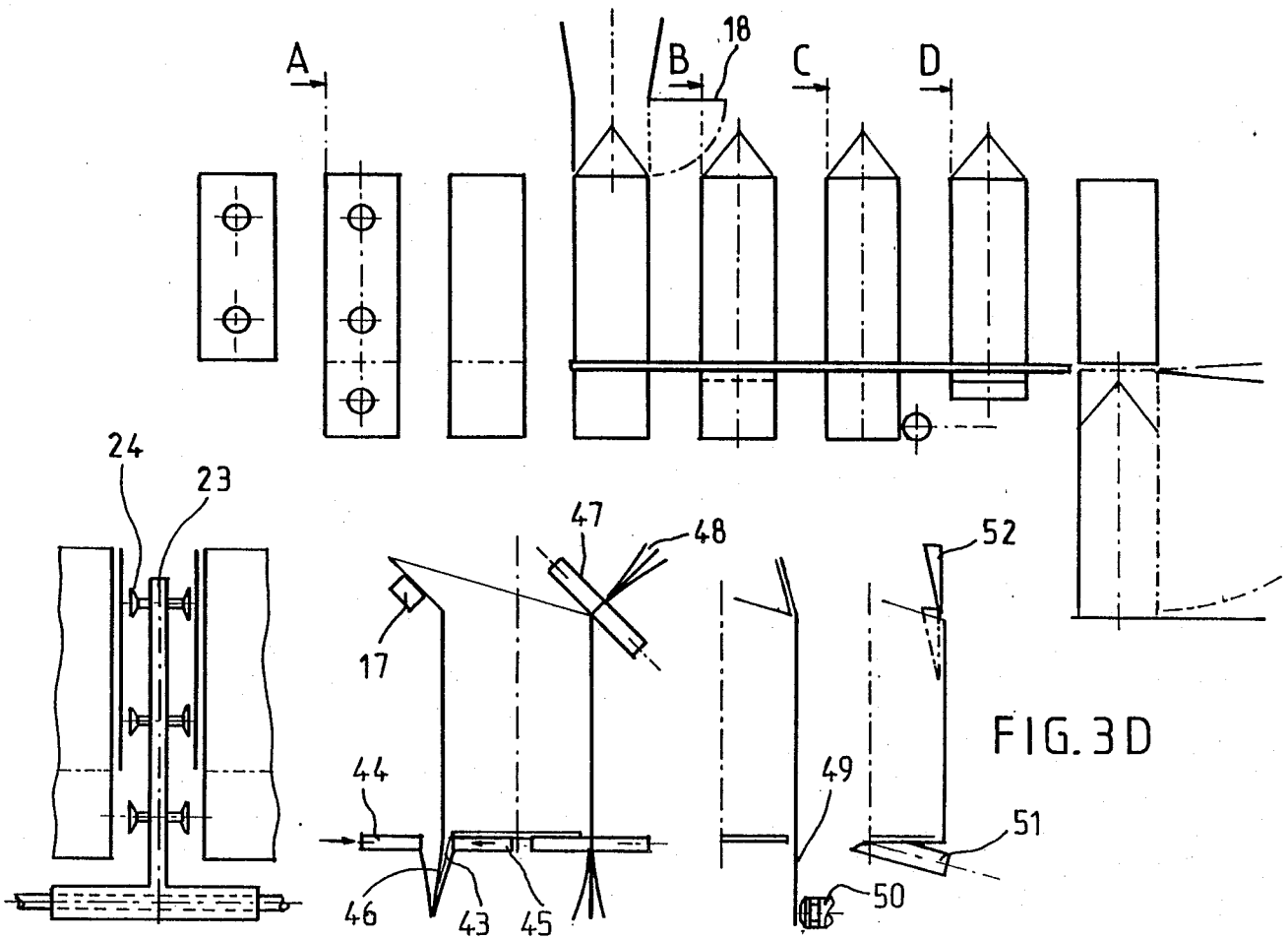
FIG. 3A is a view from A of the station for taking up the reinforcing pieces.
FIG. 3B is a view from B of the station for pressing and welding three points of the cushion-like bag, before the start of the operation and after completion of the latter.
FIG. 3C is a view from C of the station for glueing of one wing of a reinforcing piece.
FIG. 3D is a view from D of the station for sticking the two wings to one another.

When the cushion-like bags fall onto the rail (9), they take on a shape which is shown diagrammatically in FIG. 3B. Thus, the two lower corners form points which protrude downwards, as also illustrated in granted European patent 142,456 of the applicant. FIG. 3B also shows the abovementioned stopper (17). It will be understood that the two upper points, including that comprising the stopper (17), jut upwards and for this reason the chute comprises a guide (18) which follows the cushionlike bag until it is in position on the rail, after which this guide turns upwards, as shown diagrammatically in FIG. 3, to enable the cushion-like bag to pass and to progress towards the other stations.

At the end of the process on the rail (9), the latter stops (see FIG. 3) and releases the bottom of the sachet at station (13). The jaws of the clamps, which are fastened at the top, then allow the sachet to slide, and it falls towards the bagging device (exterior packing station) (14), from where it is then discharged by a conveyor belt (15).

It will now be endeavoured to describe the conveying of the cushion-like bag and the various processes it goes through between the chute (8) and being discharged at the station (13).

On arrival via the chute in the shaping device proper, the cushion-like bag joins a process which has already commenced upstream, as will be described.

Figures 2, 4, 4A, 7:
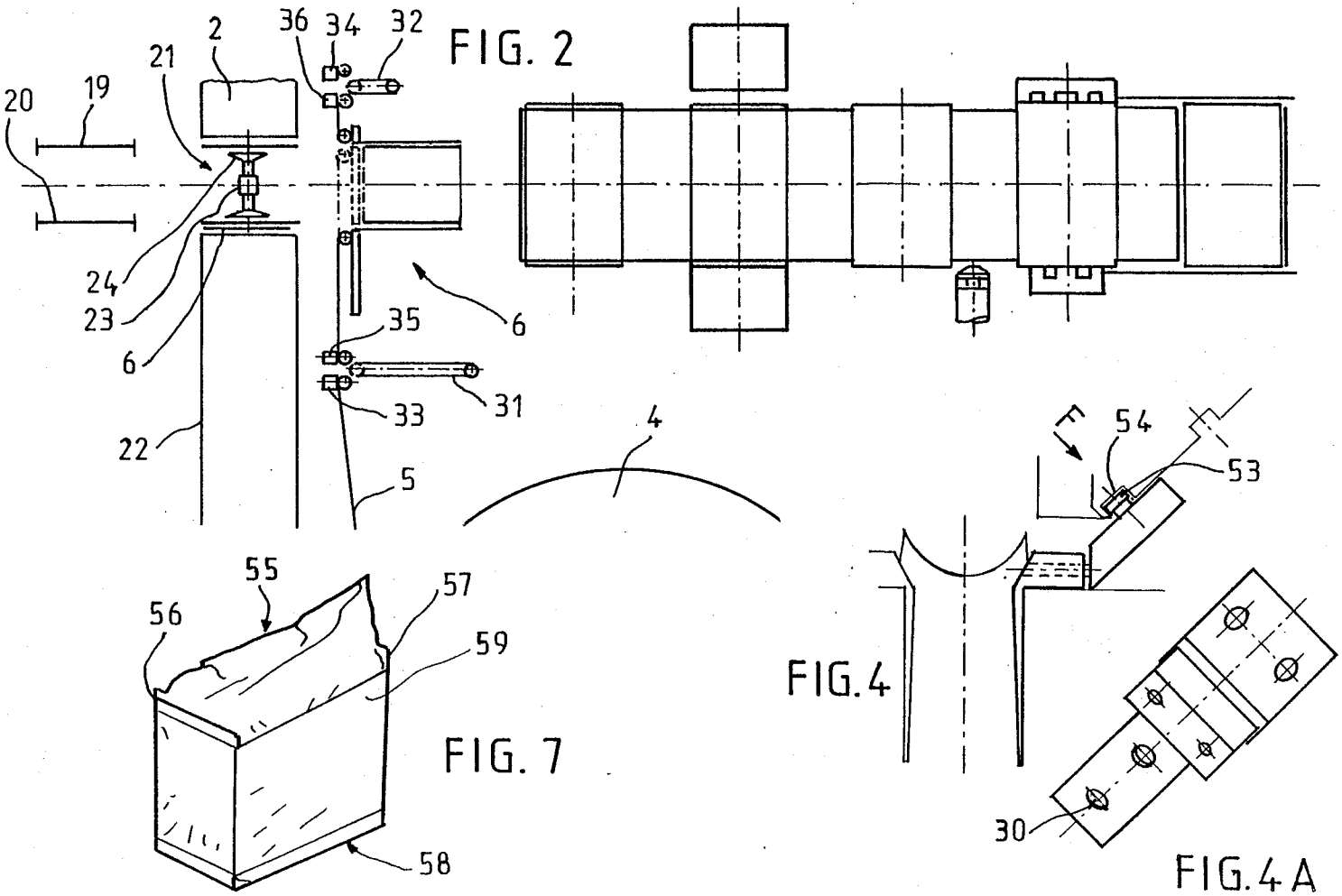
FIG. 2 is a diagrammatic elevation of the device of the invention.
FIG. 4 is a sectional view of the jaw of a clamp.
FIG. 4A is a view from F of the clamping jaw of FIG. 4.
FIG. 7 is a view of a sachet according to the invention.

Reference will first be made to FIG. 2.

The basis of the operation of the device according to the invention consists of a plurality of pairs of clamping jaws (19, 20) which are parallel to one another, parallel to the rail (9) and capable of being displaced parallel to the latter.

These clamping jaws, of which each pair forms a kind of "clamp", are displaced in indexed manner stepwise, or possibly continuously. Each clamp follows a complete cycle of the device as far as the discharge before returning to the end of the process. At this location, the clamp is arranged as shown diagrammatically in FIG. 2.

Progressing by one step (for a device with indexed forward motion), the clamp is located at the station (21) for taking up the reinforcing pieces. This station comprises at least one, preferably two magazines (2, 22) containing the reinforcing pieces (3).

The reinforcing pieces (3) have several functions in the sachet which is finally obtained, namely:

elements of vertical and bottom stiffening, as disclosed in European Patent Application 197,875 of the Applicant;

gripping elements (handle) as disclosed in granted European Patent 146,482 of the Applicant;

mounting for information, which may receive for example a conventional lable, having the legally compulsory elements, the make of the product, etc.

Figure 6:
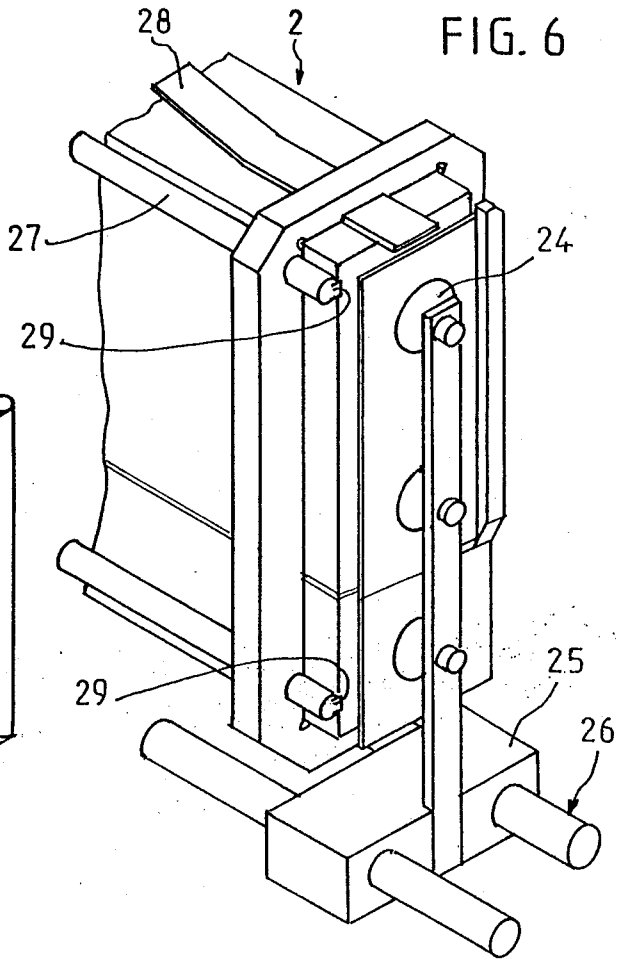
FIG. 6 is a view in perspective of the station for the taking of reinforcing pieces by the jaws of the clamps.

At the station (21) for taking up the reinforcing pieces, the device has a ramp (23) provided on its two faces, and parallel to the axis of motion through the process of the clamping jaws, suction cups (24), for example three in number as shown in FIG. 6. If there are two magazines (2, 22), they will of course be two opposite sets of suction cups. The ramp (23) holding the suction cups forms, with a base (25) shown in FIG. 6, a moving element (23) of tranverse translational motion with respect to the axis of displacement of the clamps on a slide (26). Thus, at this station, the moving element (or ramp) (23) can be displaced alternately from one magazine to the other, each time taking up one reinforcing piece via the suction cups, if necessary with pneumatic suction and suitable locking.

The structure of the magazines (2, 22) is illustrated in FIG. 6. They comprise a framework (27) for holding the reinforcing pieces which are guided there by a resilient guide (28) as far as the exit of the magazine in a manner which is known per se. A spring (not shown) pulls the reinforcing pieces towards the front exit of the magazine. At this location, reinforcing pieces are held temporarily, until they are taken up by the suction cups, by resilient catches (29) which are integrally formed, for example, with the framework (27).

As can be seen from FIG. 2, it will be found that the jaws of the clamp which is at the station for taking up the reinforcing pieces are arranged between the front ends of the magazines (2, 22) and the suction cups (24). The reinforcing pieces must thus be taken up via the clamping jaws (19, 20) which are perforated, as shown in FIG. 4A, with as many orifices (30) as there are suction cups at the position of the clamping jaw.

The suction cups then return to rest position and the reinforcing pieces are held on each respective clamping jaw by means of small stubs, behind which they snap into place. Then, the clamp, of which each jaw now supports a reinforcing piece, is displaced by one step towards the next station, which is that of shaping the sleeve.

This station, in general designated (6) in FIGS. 2 and 5, will now be described in detail.

It comprises a spool (4) for feeding film (5) which passes between two systems of forward rollers (31, 32), which are known per se. The feeding spool and the forward rollers (paying-out device) have vertical axes. They prepare the desired length of film in order that the latter can completely envelope the assembly formed by the clamp and the two reinforcing pieces without the film being stretched.

In practice, the clamp coming from stage (21) meets a film which is held taught between the rollers (32) and (31), onto which a sufficient quantity of film has already been paid out, which is now held there by break blocks (33, 34). At this point, brakes (35, 36) arranged symmetrically with respect to the above, and on the other side with respect to the rollers (31, 32) are released.

Figure 5:
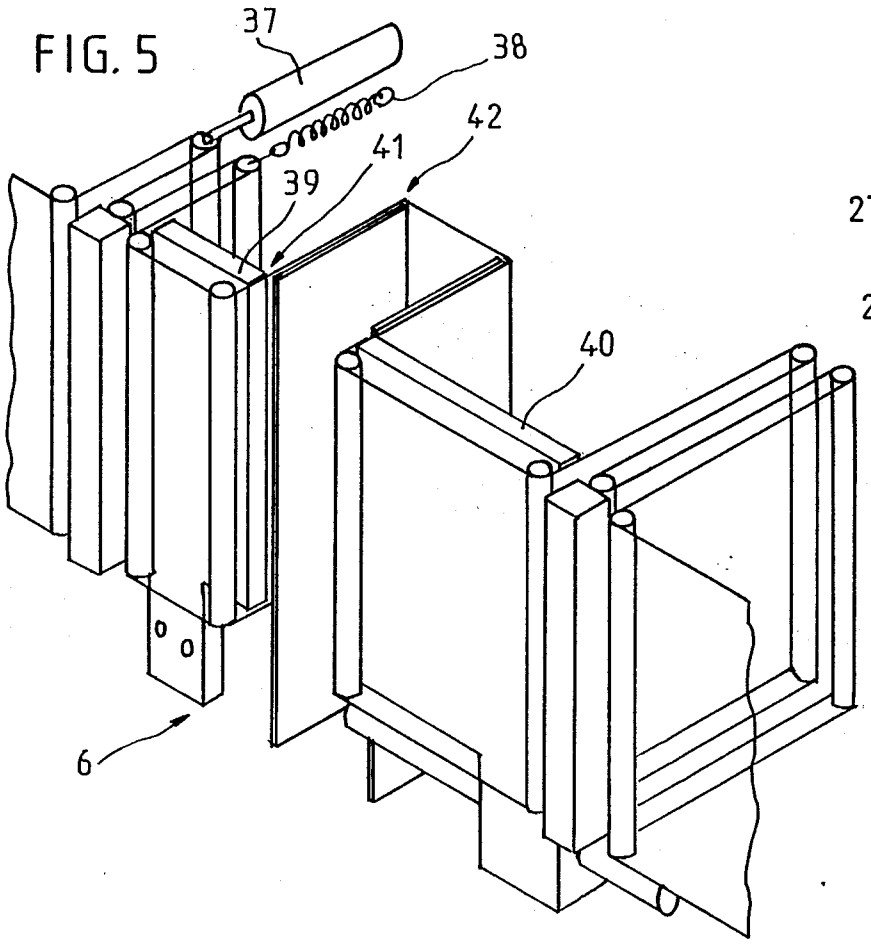
FIG. 5 illustrates in more detail and in perspective the station for giving shape to the stretchable sleeve.

Such paying-out systems, where appropriate with more improvements, are known per se and will thus not be more improvements, are known per se and will thus not be described in more detail. The displacement of the rollers (31, 32) is, for example, performed by jacks (37)

and retracting springs (38), as shown diagrammatically in FIG. 5.

At this station, the film is unwound by a predetermined length and envelops the assembly formed by the clamp and the reinforcing pieces which it carries.

The film is then welded and cut to form a sleeve. This operation is performed as follows.

When the clamp has brought with it the portion of the film enveloping it on three faces, as shown in FIG. 5, a welding clamp having two bars (39, 40) closes to form the sleeve around the clamp.

The bars (39, 40) of the welding clamp are asymmetrically displaced. In fact, it has been found that during the later stretching of the sleeve (see below), the stretching was minor at the location of the reinforcing pieces and at its greatest in the region of the sachet which does not comprise the said reinforcement pieces, that is to say between the clamps. To avoid having vertical welding lines in this free zone, which is undesirable from an aesthetic point of view, since on leaving the device these zones correspond to the transparent faces of the sachet, welding is thus performed on the edge of a reinforcing piece, preferably the front reinforcing piece, that is to say the side with the stopper.

To arrive at this result, one of the bars will be nearly immobile and the second, for example the bar (40), will bring with it a length of film; the welding and cutting will be performed at the location of the edge (41).

For the following sachet, the displacement of the rollers are determined such that the corresponding weld on the film (5) will then be found on the other edge (42) of the sachet, and so on.

On leaving this welding and cutting station, the assembly thus consists of two clamping jaws, on the external face of which there is arranged a reinforcing piece, all these elements being enveloped by an unstretched sleeve. To prevent the latter from sliding, it can for example be held in position by belts which move parallel to the rail.

Following this, between the station (6) and the station for receiving the cushion-like bags coming from the chute, the jaws of the clamp are moved away in a direction which is perpendicular with respect to the rail, this movement away between the two clamping jaws being controlled as a function of the desired extent of stretching, which is permissible for the film without tearing it, without breaking at the welding lines and without a permanent extension.

The functioning of the station for receiving the cushion-like bags between the clamping jaws via the chute (8) has already been explained above.

At this stage, the cushion-like bag assumes the configuration of FIG. 3B, on the left of the figure, the two lower points (43) assuming the said configuration, that is to say protruding downwards with respect to the rail.

The liquid contained in the points (43) is pushed out of the latter by a pair of pressing and welding jaws (44, 45), the structure of which is the subject of another patent application, filed by the applicant on the same date. The welding and pressing are in any case carried out via the wing (46) of the reinforcement, which also protrudes downwards, the said reinforcement being of cardboard which is coated at this point with polyethylene on its internal face for welding.

The right hand part of FIG. 3B shows the final position of the clamping jaws (44, 45), the liquid having been completely removed from the points, which are now welded.

In conjunction with this, a clamp (47) of the same type as those above removes the liquid contained in the upper part (48) opposite the stopper. Welding is carried out at the same time, preferably without cutting.

Then, one of the wings (49) is glued by a glueing nozzle (50), as illustrated in FIG. 3C. At the station (12) which follows, the two wings are folded against one another and stuck to one another by means of two pairs of pistons (51) arranged on each side of the rail and provided with teeth which overlap with one another. The two wings were both pressed and stuck to one another.

At the same station, a wedge (52) mechanically inserts the welded point (48) between the body of the sachet and the back reinforcement.

Then, at the following station, the rail stops and the sachet falls towards the stations for bagging and exterior packaging, as described above, after the clamping jaws have approached and the sleeve has been removed.

The clamps then return to the starting point of the device and the process restarts.

In this regard, FIGS. 4 and 4*a*, which show the jaw of a clamp, should be referred to.

The clamping jaws are fastened at the top and are subject to displacement by rollers (53) in slides (54) forming a curved path. Thus, simply by the configuration of the said curved path, the motion of the jaws of the clamps towards one another or away from one another is determined.

FIG. 7 shows the sachet obtained according to the invention.

It is in the form of a flexible and generally transparent body (55) enclosed by side reinforcing pieces (56, 57) connected to the base to form a bottom (58). All these elements are held by a sleeve (59).

The sachet of the invention can be marketed as unit or in multiple form.

It is more particularly intended for the packaging of liquid food products such as mineral waters, spring waters, table waters, fruit drinks and fruit-type drinks, milky drinks, milk, etc.

I claim:

1. A sachet of flexible synthetic material comprising:
a flexible body for containing a liquid; and
means for receiving and supporting the flexible body comprising one or more side reinforcing pieces connected at a base to form a bottom portion and a sleeve for engaging the side reinforcing pieces to define a container for receiving the flexible body;
wherein the flexible body is frictionally contained within the receiving and supporting means and wherein said friction is the only means for retaining the flexible body within the receiving and supporting means.

2. A sachet according to claim 11 wherein the flexible body is formed of a transparent material.

3. A sachet according to claim 1 wherein the sleeve is formed of a transparent material.

4. A sachet according to claim 3 wherein the flexible body is formed of a transparent material.

5. A sachet according to claim 1 wherein the sleeve is formed of a cold-stretchable material.

6. A sachet according to claim 1 wherein the reinforcing pieces are made of cardboard and coated on an internal face with polyethylene.

7. A sachet according to claim 1 wherein the receiving and supporting means has two stiffening elements, each on one side face of the body with free ends of the stiffening elements attached so that shape and support are given to the bottom portion of the body.

8. A sachet according to claim 1 wherein the receiving and supporting means has a single stiffening element on the bottom portion of the body so that wings of the stiffening element are folded back on the side faces of the body to provide shape and support.

9. A sachet according to claim 1 wherein the flexible body includes an opening and closing stopper.

10. A sachet according to claim 1 wherein the side reinforcing pieces form a gripping element.

11. A sachet according to claim 11 wherein the side reinforcing pieces form a surface for receiving labelling means.

12. A sachet according to claim 1 wherein the flexible body includes two corner flaps which are folded, pressed and attached to one another.

13. The sachet of claim 1 wherein the sleeve is formed of cold-stretchable material and the receiving and supporting means has two stiffening elements, each positioned on one side face of the body with ends of the stiffening elements attached so that shape and support are given to bottom portions of the body.

* * * * *